US008098857B2

(12) United States Patent
Sörgel

(10) Patent No.: US 8,098,857 B2
(45) Date of Patent: Jan. 17, 2012

(54) HEARING AID HAVING AN AUDIO SIGNAL GENERATOR AND METHOD

(75) Inventor: Wolfgang Sörgel, Erlangen (DE)

(73) Assignee: Siemens Audiologische Technik GmbH, Erlangen (DE)

( * ) Notice: Subject to any disclaimer, the term of this patent is extended or adjusted under 35 U.S.C. 154(b) by 1127 days.

(21) Appl. No.: 11/888,195

(22) Filed: Jul. 31, 2007

(65) Prior Publication Data

US 2008/0107295 A1 May 8, 2008

(30) Foreign Application Priority Data

Aug. 4, 2006 (DE) ..... 10 2006 036 582

(51) Int. Cl.
*H04R 25/00* (2006.01)

(52) U.S. Cl. ..... 381/314; 381/46; 381/153; 381/68; 704/258

(58) Field of Classification Search ..... 704/258; 381/314, 46, 153, FOR. 140
See application file for complete search history.

(56) References Cited

U.S. PATENT DOCUMENTS 5,353,377 A * 10/1994 Kuroda et al. ..... 704/256.1
5,832,431 A * 11/1998 Severson et al. ..... 704/258

FOREIGN PATENT DOCUMENTS

| | | | |
|---|---|---|---|
| DE | 4206084 | C1 | 12/1992 |
| EP | 0 480 097 | A1 | 4/1992 |
| EP | 1 467 595 | A2 | 10/2004 |
| EP | 1615468 | A1 | 1/2006 |
| WO | 0130127 | A2 | 5/2001 |
| WO | 0241296 | A1 | 5/2002 |

* cited by examiner

*Primary Examiner* — Kenneth Parker
*Assistant Examiner* — Dale E Page

(57) ABSTRACT

The invention relates to a hearing aid having a sound receiver and a sound generator. The hearing aid also has an audio signal unit that is functionally linked to the sound generator and has a tone signal generator for generating a tone signal as a function of a trigger signal and of a generation parameter which represents a frequency that can be perceived by a human ear. The hearing aid also has a memory, connected to the tone signal generator, for storing the generation parameter. The audio signal unit changes the generation parameter stored in the memory, generates a trigger signal for each tone signal requiring to be generated, sends said trigger signal to the tone signal generator, and sends the generated tone signal to the sound generator.

17 Claims, 2 Drawing Sheets

HEARING AID HAVING AN AUDIO SIGNAL GENERATOR AND METHOD

CROSS REFERENCE TO RELATED APPLICATIONS

This application claims priority of German application No. 10 2006 036 582.8 filed Aug. 4, 2006, which is incorporated by reference herein in its entirety.

FIELD OF THE INVENTION

The invention relates to a hearing aid having at least one sound receiver and one sound generator. The at least one sound receiver is embodied for receiving sound waves and for generating a microphone signal representing the received sound waves. The hearing aid also has a transmitting unit connected on the input side to the at least one sound receiver and on the output side to the sound generator. The transmitting unit is embodied for receiving the microphone signal on the input side and, as a function of the microphone signal received on the input side, for generating a power signal at least partially representing the microphone signal. The sound generator is embodied for receiving the power signal on the input side and, as a function of the power signal received on the input side, for generating a sound corresponding to the power signal.

BACKGROUND OF THE INVENTION

Hearing aids known from the prior art are embodied for generating an acknowledgement tone as a function of an event and for playing back said tone via the sound generator. An acknowledgement tone of said type—in the form of, for instance, a section of a sinusoidal or rectangular signal—can be perceived as being unpleasant.

SUMMARY OF THE INVENTION

The object underlying the invention is thus to disclose another hearing aid capable of generating an acknowledgement tone exhibiting an improved tone quality.

Said object is achieved by means of a hearing aid of the type cited in the introduction, with the hearing aid having an audio signal unit that is functionally linked to the sound generator and has at least one tone signal generator. The at least one tone signal generator is embodied for generating a tone signal as a function of a trigger signal and of at least one generation parameter. The tone signal represents at least one frequency that can be perceived by a human ear.

The hearing aid also has a memory, connected to the at least one tone signal generator, for the at least one generation parameter. The audio signal unit is embodied for changing the at least one generation parameter stored in the memory. The audio signal unit is embodied for generating a trigger signal for each tone signal requiring to be generated and for sending said trigger signal to the tone signal generator. The audio signal unit is embodied for sending the at least one generated tone signal to the sound generator. A tone signal provided for, for example, acknowledging an event can in that way be generated in a manner advantageously saving memory capacity.

The audio signal unit is preferably embodied for generating the trigger signal as a function of an event, in particular as a function of an event signal representing the event. The audio signal unit can for that purpose have an input for the event signal and be embodied for generating the trigger signal as a function of the event signal. The event can be, for example, a user interaction, a response of the hearing aid to a user interaction, or a status of a process being executed in the hearing aid. For example the event can be a battery charge status of a battery connected to the hearing aid.

The tone signal can represent, for example, an instrumental sound or a vocal sound. A generation parameter can for that purpose represent, for example, the instrumental sound or vocal sound, a volume, a frequency, or a harmonic range of the tone signal requiring to be generated. A generation parameter can as a result be changed advantageously separately from a trigger parameter.

An instrumental sound can be, for example, an instrumental sound produced by a keyboard instrument, in particular a piano sound, a harpsichord sound, or an organ sound, or a sound produced by a wind instrument, in particular a flute, an oboe, a bassoon, a trumpet, a trombone, a horn, or a clarinet, or one produced by a stringed instrument, in particular a violin, a viola, a cello, or a contrabass, or one produced by a plucked-string instrument, in particular a mandolin, a guitar—in particular an electric guitar—, or zither, or one produced by a percussion instrument, in particular a drum, sets of timpani, a cymbal, a cowbell, a triangle, or a castanet. A generation parameter can represent, for example, a predefined sound produced by a musical instrument, corresponding in particular to an operated piano pedal or corresponding to an actuated brass-instrument mute.

The audio signal unit can generate a sequence of trigger signals for playing a tune, for example. Thanks to the generation parameters stored in the memory the audio signal unit can advantageously generate the tune in such a way that a generation parameter will be changed only if necessary for generating the tune. Memory capacity can in that way be advantageously saved when datasets each representing one tune are stored. For example the audio signal unit can have a plurality of tone signal generators for generating a polyphonic tune.

In a preferred embodiment the audio signal unit is embodied for receiving a generation parameter dataset that represents the generation parameters and for changing the generation parameters stored in the memory in such a way that the generation parameters stored in the memory and the corresponding generation parameters represented by the generation parameter dataset represent mutually identical values.

For example the audio signal unit can overwrite a generation parameter stored in the memory with a generation parameter represented by the generation parameter dataset.

In a preferred embodiment the generation parameters represented by the generation parameter dataset are each represented by at least one codeword, in particular by precisely one codeword, with a codeword being assigned to at least one tone signal requiring to be generated. A generation parameter for a tone signal requiring to be generated can thereby be advantageously changed in a manner saving memory capacity, with its being possible for the changed generation parameter to be effective for one tone signal requiring to be generated or for a plurality of tone signals requiring to be generated.

In an advantageous embodiment at least one codeword is assigned to a tone signal generator. The tone generator can advantageously be selectively controlled thereby. A tone signal representing a sound can as a result be advantageously generated by a tone signal generator in a manner that saves memory capacity. The audio signal unit can have a plurality of tone signal generators and consequently advantageously generate a polyphonic tune.

In an advantageous embodiment the at least one codeword represents at least one generation parameter. A generation parameter can in that way be advantageously changed selectively. A codeword can represent precisely one generation parameter. That enables fast and simple interpreting.

In a preferred embodiment the audio signal unit has a buffer for the at least one generation parameter dataset. Generation parameter datasets stored in the buffer can, for example, advantageously each contain codeword datasets, with the codeword datasets together representing a tune. The codeword datasets can hence together form a generation parameter dataset.

In a preferred embodiment the at least one codeword represents an item of information about a following codeword. A following codeword can be represented in, for example, the buffer by a following codeword dataset of a sequence of codeword datasets.

In a preferred embodiment the audio signal unit is embodied for reading the at least one codeword bit-by-bit. The audio signal unit can for that purpose have a read unit that is connected to the buffer and embodied for reading out codeword datasets stored in the buffer. The audio signal unit, in particular its read unit, can as a result be advantageously implemented in a technically simple manner.

In a variant embodiment the codeword is a codeword from a redundancy-reducing code. A redundancy-reducing code can be an arithmetic code or a Huffmann code. A redundancy-reducing code preferably has mutually different codewords, with the mutually different codewords each having a mutually different codeword length, in particular as a function of an item of represented information. Redundantly occurring information is thereby advantageously reduced.

The invention relates also to a method for generating at least one tone signal by means of a hearing aid having a sound generator, with

- at least one generation parameter being stored for the tone signal requiring to be generated;
- a tone signal being generated as a function of a trigger signal and as a function of the at least one stored generation parameter and with the generated tone signal being played back by means of the sound generator;
- one further tone signal being generated as a function of a trigger signal and of the at least one stored generation parameter, or
- at least one stored generation parameter being changed and thereupon one further tone signal being generated as a function of a trigger signal and of the at least one changed stored generation parameter and with the further generated tone signal being played back by means of the sound generator.

Further advantageous variant embodiments will emerge from the features cited in the dependent claims or from a combination of said features.

BRIEF DESCRIPTION OF THE DRAWINGS

In the Specification, please add the paragraph at page 6 line 33, as follows: —

The invention will now be explained below with reference to figures and further exemplary embodiments.

DETAILED DESCRIPTION OF THE INVENTION

Figure 1:
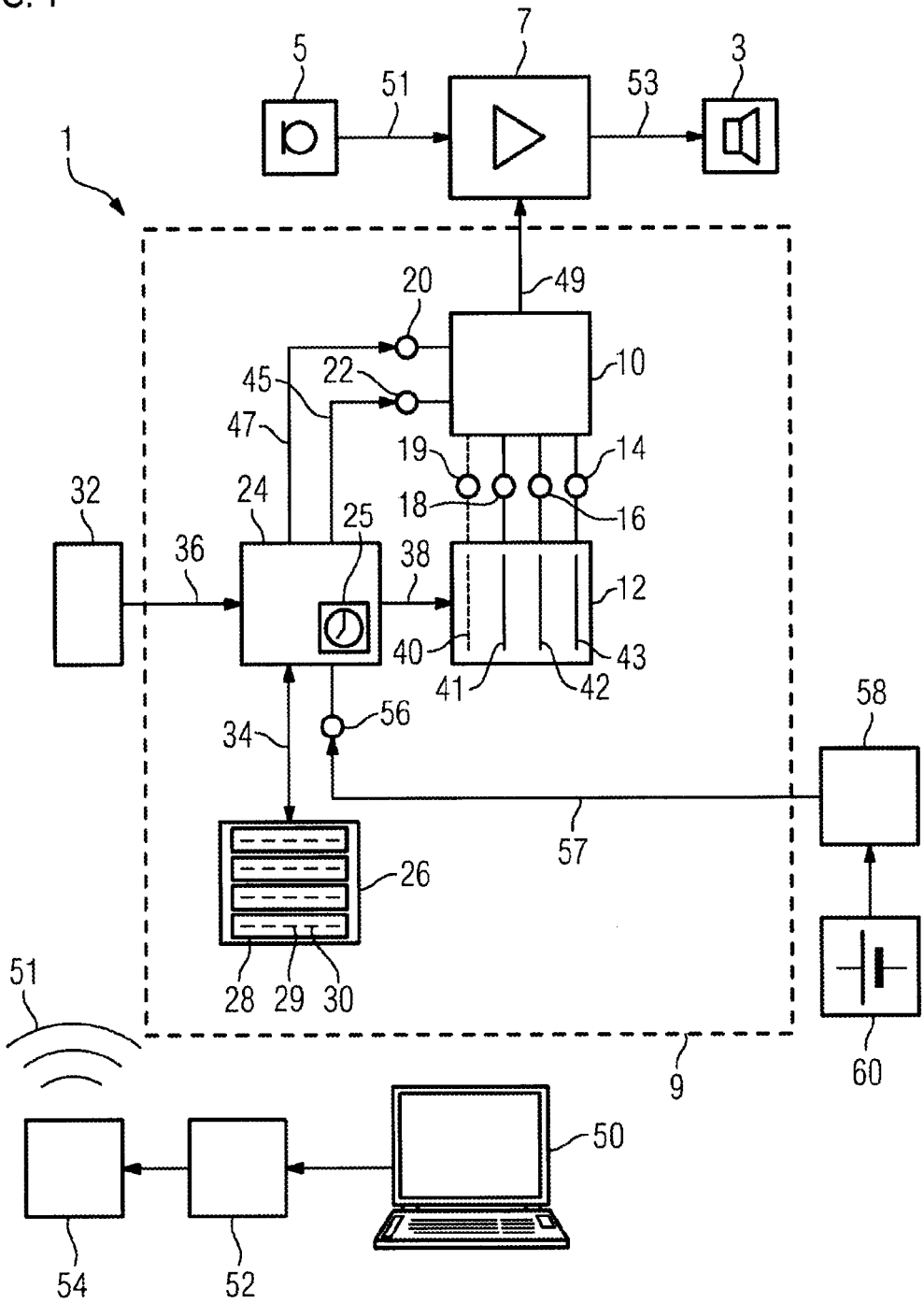
FIG. 1 shows an exemplary embodiment of a hearing aid.

FIG. 1 shows an exemplary embodiment of a hearing aid 1 having a sound receiver 5, a transmitting unit 7, and a sound generator 3. The way in which the transmitting unit 7, the sound receiver 5, and the sound generator 3 function and interoperate is as described above.

The transmitting unit 7 is connected on the input side to the sound receiver 5 via a connecting lead 51 and on the output side to the sound generator 3 via a connecting lead 53. The transmitting unit 7 also has a further input for a tone signal. The transmitting unit 7 is embodied for generating a corresponding power signal as a function of a tone signal received on the input side and for sending said power signal to the sound generator 3 via the connecting lead 53.

The hearing aid 1 has an audio signal unit 9. The audio signal unit 9 includes a tone signal generator 10 and a memory 12. The tone signal generator 10 has a frequency input 14 for receiving a frequency signal, a level input 16 for receiving a level signal, a sound input 18 for receiving a sound signal, and a tone duration input 19 for receiving a tone duration signal. The tone signal generator 10 also has a trigger input 20 for receiving a trigger signal and a tone stop input 22 for receiving a tone stop signal.

The frequency input 14, the level input 16, the sound input 18, and the tone duration input 19 are each connected to the memory 12 via a connecting lead. Generation parameters 40, 41, 42, and 43 are stored in the memory 12. The generation parameter 40 is assigned to the tone duration input 19, the generation parameter 41 is assigned to the sound input 18, the generation parameter 42 is assigned to the level input 16, and the generation parameter 43 is assigned to the frequency input 14. The memory 12 is embodied for making the generation parameters 40, 41, 42, and 43 available on the output side.

The tone signal generator 10 is embodied for generating a tone signal as a function of the generation parameters 40, 41, 42, and 43 received on the input side and for generating a tone signal as a function of a drive signal received via the trigger input 20, and for outputting said tone signal on the output side to the transmitting unit 7 via the connecting lead 49.

The generation parameters 40, 41, 42, and 43 can each represent a value which in the case of the generation parameter 40 corresponds to a tone duration of a tone signal requiring to be generated, in the case of the generation parameter 41 corresponds to a sound, in particular an instrumental sound of a tone signal requiring to be generated, in the case of the generation parameter 42 corresponds to a level and hence to a volume of a tone signal requiring to be generated, and in the case of the generation parameter 43 corresponds to a frequency and hence to a pitch of a tone signal requiring to be generated.

The hearing aid 1 also has a central control unit 24. The central control unit 24 is connected on the output side to the tone stop input 22 via a connecting lead 45 and to the trigger input 20 via a connecting lead 47. The central control unit 24 is connected on the output side to the memory 12 via a connecting lead 38. The central control unit 24 is also connected via a connecting lead 36 to a user interface 32 and via a connecting lead 34 to a buffer 26, referred to below also as a tune memory. The tune memory 26 can store at least one or a plurality of datasets, with one dataset 28 being shown as an example. The dataset 28 represents a tune and includes a plurality of codewords represented by codeword datasets, among which the codewords 29 and 30 are shown as an example.

The codeword 29 represents in this exemplary embodiment a sound of a tone signal requiring to be generated and the codeword 30 represents in this exemplary embodiment a frequency of a tone signal requiring to be generated. A codeword can represent, for example, a level of a tone signal requiring to be generated or a tone duration of a tone signal requiring to be generated. All the codewords in a dataset can in that way together form a codeword sequence representing a tune.

The central control unit has an input 56 for an event signal. The input 56 for an event signal is connected via a connecting lead 57 to a control unit 58 embodied for generating the event signal as a function of an event. The control unit 58 is connected on the input side to a battery sensor 60 for registering a charge status of a battery connected to the hearing aid. The battery sensor 60 is embodied for generating a battery signal corresponding to the predefined charge status of the connected battery and for outputting said signal on the output side. The control unit can generate, for example, an event signal corresponding to a process status of a process of the hearing aid. A process can be an act of communicating with a user, for example selecting a hearing program, or a system test on at least one component of the hearing aid. The central control unit 24 can read out a dataset, corresponding to the event signal, from the memory 26 and cause said dataset to be generated by means of the tone signal generator 10. For example the battery signal can be assigned a predefined dataset representing, for instance, a descending tone sequence. The central control unit 24 is embodied for selecting a dataset from the tune memory 26 via the connecting lead 34—for example as a function of an event signal received on the input side or of a user interaction signal received on the input side via the connecting lead 36—and for reading out said dataset via the connecting lead 34. The central control unit 24 is embodied for interpreting the read-out dataset 28 reading bit-by-bit. The central control unit 24 can for that purpose interpret each codeword it reads—in particular bit-by-bit—in accordance with a look-up table. The central control unit 24 can thus, for example, assign a codeword to a generation parameter or to a further interpreting instruction.

In the case of an assigned generation parameter the central control unit 24 can send the assigned generation parameter via the connecting lead 38 to the memory 12 and store it there at a storage location provided for the generation parameter and there overwrite an already stored generation parameter.

When, for example, all generation parameters, in particular the generation parameters requiring to be changed—have been read and interpreted for a tone signal requiring to be generated and then stored at the appropriate storage location in the memory 12, the central control unit can generate a drive signal for generating a tone signal and send said drive signal on the output side via the connecting lead 47 to the tone signal generator 10 and there to the trigger input 20. The tone signal generator 10 can generate a tone signal as a function of the drive signal received on the input side and as a function of the generation parameters 40, 41, 42, and 43 received on the input side, with a characteristic of the tone signal corresponding to the generation parameters 40, 41, 42, and 43.

The user interface 32 can be embodied for the cordless reception of at least one sent dataset 51 and/or one user interaction signal. The central control unit 24 can receive a dataset 51 sent via the connecting lead 36 and store it as a dataset in the memory 26 via the connecting lead 34. The memory 26 can hence store mutually different datasets each representing mutually different tunes.

In this exemplary embodiment the sent dataset 51 has been generated by a programming system for the hearing aid 1. The programming system includes a personal computer 50, a Midi (Midi=Music Instrument Digital Interface) converter 52, and an interface 54 for the cordless transmission of datasets. The Midi converter 52 is embodied for converting a Midi signal, received on the input side, in accordance with a predefined assignment rule and for generating a dataset comprising codewords as the conversion result. In this exemplary embodiment the Midi signal is generated by the personal computer 50 and output on the output side to the Midi converter 52. The Midi signal and the dataset generated by means of the Midi converter 52 in each case represent the same tune.

The interface 51 and interface 32 can each be embodied as a radio frequency interface, in particular for the inductive transmission of a dataset.

Figure 2:
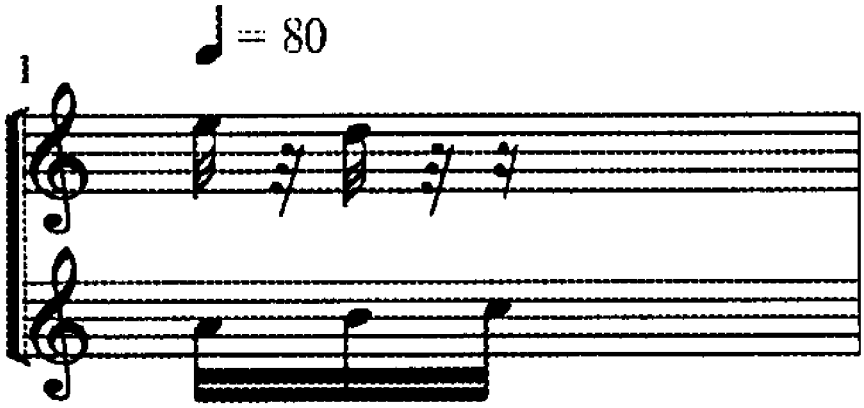
FIG. 2 shows a tune represented by a dataset shown in FIG. 1.

FIG. 2 is an exemplary embodiment of a tune that can be represented by a dataset, for example the dataset 28 shown in FIG. 1.

In this exemplary embodiment the dataset corresponding to the above tune has codewords with a mutually different bit length. The dataset is formed by the following bit sequence:
>1010010000010111010010010110111100000011111111-1111000000101101 1001001100011110000001111111111-111000001001100111110010000<

The bit sequence in the above-described dataset will be explained with the aid of Table 1 below:

TABLE 1

| Codeword | Context/Table | Description |
|---|---|---|
| 1010 = 10 | Sound | Indication of a change in tempo |
| 0100 = 4 | Tempo | Tempo value 80 bpm (bpm = beats per minute) |
| 0001 = 1 | Sound | Selection of sound 1 |
| 011101 = 29 | Note | Note value 29 corresponding to Midi 76, 'e' for sound1 |
| 0010 = 2 | Sound | Selection of sound 2 |
| 010110 = 22 | Note | Note value 22 corresponding to Midi 69, a' for sound2 |
| 1111 = 15 | Sound | Changeover to time |
| 000 = 0 | Time | Duration 1 tick = 1/32 of a note |
| 0001 = 1 | Sound | Selection of sound 1 |
| 111111 = 63 | Note | End of tone for sound 1/begin pause |
| 1111 = 15 | Sound | Changeover to time |
| 000 = 0 | Time | Duration 1 tick = 1/32 of a note |
| 0001 = 1 | Sound | Selection of sound 1 |
| 011011 = 27 | Note | Note value 27 corresponding to Midi 74, d" for sound1 |
| 0010 = 2 | Sound | Selection of sound 2 |
| 011000 = 24 | Note | Note value 24 corresponding to Midi 71, h' for sound2 |
| 1111 = 15 | Sound | Changeover to time |
| 000 = 0 | Time | Duration 1 tick = 1/32 of a note |
| 0001 = 1 | Sound | Selection of sound 1 |
| 111111 = 63 | Note | End of tone for sound 1/begin pause |
| 0010 = 2 | Sound | Selection of sound 2 |
| 011001 = 25 | Note | Note value 25 corresponding to Midi 72, c" for sound2 |
| 1111 = 15 | Sound | Changeover to time |
| 001 = 1 | Time | Duration 2 ticks = 1/16 of a note |
| 0000 = 0 | Sound | End of tune, end of tone for all sounds |

In this exemplary embodiment each codeword requiring to be interpreted represents—in accordance with a binary code—a context according to which the codeword is to be interpreted. A corresponding decimal value is shown after an equals sign in Table 1. A default context—as a start condition—is, for example, a sound context. The first codeword has a bit length of 4 bits and corresponds in the sound context to a change in tempo. The next codeword is accordingly to be interpreted as a tempo codeword and represents a tempo value of 80 beats per minute. The next codeword is in the specified context, namely the sound context, and represents a selection of a first sound. The first sound can correspond to, for example, the sound of a flute. The next codeword has a bit length of 6 bits and represents a generation parameter for a frequency, namely one corresponding to the tone e". The next codeword is in the sound context and hence represents the generation parameter sound, with said codeword representing a second sound, for example that produced by a violin. The next codeword represents a generation parameter for a frequency, namely the note value a'. The next codeword represents a changeover to the duration context. The next codeword represents a duration corresponding to one thirty-second of a note. The next codeword is in the default-context, namely the sound context, and represents the selection of a sound, namely the first sound. The next codeword 10 represents a beginning of a pause for the first sound.

For generating the tune shown in FIG. 2 the central control unit 24 shown in FIG. 1 can already, on selection of a sound, generate a trigger signal for a tone signal generator provided for generating the sound. The tone signal generator 10 in FIG. 1, which generator has at least one, in this exemplary embodiment pertaining to FIG. 2 two single-tone signal generators, plays a first pair of tones of the tune in FIG. 2, which pair of tones are spaced a fifth apart, until the instant after the codeword 10 has been interpreted. The codeword 10 represents an end of tone for the sound 1 and hence a beginning of a pause for the sound 1. After the codeword 10 has been interpreted, the central control unit 24 in FIG. 1 can generate a tone stop signal and send it to the tone signal generator 10. The tone signal generator 10 stops generating the tone signal for the first sound as a function of the tone stop signal. The next codeword represents a duration corresponding to one thirty-second of a note. The next codeword 13 represents selecting of the sound 1, whereupon the central control unit 24 in FIG. 1 can generate a trigger signal for the tone signal generator 10. The next codeword 14 represents a frequency, namely the note value d" for the first sound. The next codeword 15 represents selecting of the second sound and the next codeword 16 represents a generation parameter for a frequency, namely the note value h'. The next codeword 17 represents a change of context to the time context. The next codeword 18 represents a duration, corresponding to one thirty-second of a note. The next codeword 19 represents selecting of the first sound, whereupon the central control unit 24 in FIG. 1 can generate a trigger signal for the tone signal generator 10. The next codeword 20 represents an end of tone for the first sound; the central control unit 24 can thereupon generate a tone stop signal and send it to the tone signal generator 10. The next codeword 21 represents selecting of the second sound. The central control unit 24 in FIG. 1 can thereupon generate a trigger signal for the tone signal generator. The next codeword 22 represents a generation parameter for a frequency corresponding to a note value of the note c". The tone signal generator 10 in FIG. 1 can thereupon generate a tone signal corresponding to a played tone of a bassoon having the pitch c". The next codeword 23 represents a changeover to the time context. The next codeword 24 represents a duration corresponding to one sixteenth of a note. The next codeword 25 represents a tone stop signal for all sounds. The central control unit 24 can thereupon send a tone stop signal to the tone signal generator 10, which as a function thereof terminates generating of all tone signals.

The above described generating method for generating at least one tone signal advantageously requires less memory capacity because not every codeword representing a tone signal is prefixed by a codeword that represents a duration of the codeword representing the tone signal.

The generation parameter 40 shown in FIG. 1 and the connection leads to the input 19 for a tone duration are represented by dashed lines. That means that, irrespective of the input 19 and the generation parameter 40 shown in FIG. 1, a hearing aid 1 can have no input 19 and no generation parameter 40. In this exemplary embodiment a duration and a time sequence of tone signals requiring to be generated are then predefined by a time sequence for interpreting by the central control unit 24 of the codewords read out from the memory 26. The central control unit 24 can have a clock generator 25 for generating an interpreting clock for interpreting the codewords being read. The clock generator 25 can have, for example, a piezoelectric crystal.

Table 2 is a look-up table for the interpreting, in particular by the central control unit 24 in FIG. 1, of codewords being read. The codewords in Table 2 are binary codewords. According to the look-up table shown in table 2 a codeword is assigned a sound or a changeover to another context. The codewords 1 to 8 in the look-up table each represent a sound and the codeword 9 represents a changeover to a level context for generating a generation parameter for a level. The codeword 10 represents a changeover to the tempo context. The codeword 15 represents a changeover to the time context and indicates that no more tone signals will be generated. The codewords of the sound context have a bit length of 4 bits.

TABLE 2

| Codeword | Description | NewContext |
|---|---|---|
| 0000 | End of tune, tone stop for all sounds. | SoundContext = 0 |
| 0001 | Sound0 Selection | NoteContext = 1 |
| 0010 | Sound1 Selection | NoteContext = 1 |
| 0011 | Sound2 Selection | NoteContext = 1 |
| 0100 | Sound3 Selection | NoteContext = 1 |
| 0101 | Sound4 Selection | NoteContext = 1 |
| 0110 | Sound5 Selection | NoteContext = 1 |
| 0111 | Sound6 Selection | NoteContext = 1 |
| 1000 | Sound7 Selection | NoteContext = 1 |
| 1001 | Global level changeover | GlobalLevelContext = 2 |
| 1010 | Tempo changeover | TempoContext = 4 |
| 1011 | RESERVED | ERROR |
| 1100 | RESERVED | ERROR |
| 1101 | RESERVED | ERROR |
| 1110 | RESERVED | ERROR |
| 1111 | Changeover to TimeContext, no more tones | TimeContext = 5 |

Table 3 is a look-up table for codewords from the frequency context, frequency being referred to below also as note. A generation parameter for a frequency can be generated as a function of Table 3.

TABLE 3

| Codeword | Description | NewContext |
|---|---|---|
| 000000 | Note value Midi 47, "H", approx. 123.4 Hz | SoundContext = 0 |
| 000001 | Note value Midi 48, "C", approx. 130.8 Hz | SoundContext = 0 |
| 000010 . . . 111001 | . . . | . . . |
| 111010 | Note value Midi 105, "a" | SoundContext = 0 |
| 111011 | Note value Midi 106, "b", approx. 3729 Hz | SoundContext = 0 |
| 111100 | RESERVED | ERROR |
| 111101 | for instrument changeover RESERVED | ERROR |
| 111110 | Level change for current sound | SoundLevelContext = 3 |
| 111111 | Tone stop current sound | SoundContext = 0 |

Table 4 is a look-up table for codewords from the level context. A generation parameter for a level can be generated as a function of codewords according to this look-up table.

TABLE 4

| Codeword | Description/implemented value | NewContext |
|---|---|---|
| 000 = 0 | 1.0, full level | SoundContext = 0 |
| 001 | 0.5 −6 dB, initial default | SoundContext = 0 |
| 010 | 0.375 −8.5 dB | SoundContext = 0 |
| 011 | 0.25 −12 dB | SoundContext = 0 |
| 100 | 0.1875 −14.5 dB | SoundContext = 0 |
| 110 | 0.125 −18 dB | SoundContext = 0 |
| 110 | 0.0625 −24 dB | SoundContext = 0 |
| 111 | 0.0 silence | SoundContext = 0 |

Table 5 is a look-up table for codewords from the tempo context, with the codewords having a bit length of 4 bits.

TABLE 5

| Codeword | Description | NewContext |
|---|---|---|
| 0000 = 0 | Integer index indicates the tempo directly in bpm (bpm = beats per minute) | SoundContext = 0 |
| 0001 | 50 bpm | SoundContext = 0 |
| 0010 | 60 bpm | SoundContext = 0 |
| 0011 | 70 bpm | SoundContext = 0 |
| 0100 | 80 bpm | SoundContext = 0 |
| 0101 | 90 bpm | SoundContext = 0 |
| 0110 | 100 bpm | SoundContext = 0 |
| 0111 | 110 bpm | SoundContext = 0 |
| 1000 | 120 bpm; is initial default for tempo | SoundContext = 0 |
| 1001 | 130 bpm | SoundContext = 0 |
| 1010 | 140 bpm | SoundContext = 0 |
| 1011 | 150 bpm | SoundContext = 0 |
| 1100 | 160 bpm | SoundContext = 0 |
| 1101 | 180 bpm | SoundContext = 0 |
| 1110 | 200 bpm | SoundContext = 0 |
| 1111 = 15 | 240 bpm | SoundContext = 0 |

Table 6 is a look-up table for codewords from the time context, with the codewords having a bit length of 3 bits.

TABLE 6

| Codeword | Description/implemented value | NewContext |
|---|---|---|
| 000 = 0 | 1 tick, 1/32 of a note | SoundContext = 0 |
| 001 | 2 ticks, 1/16 of a note | SoundContext = 0 |
| 010 | 3 ticks, dotted 1/16 of a note | SoundContext = 0 |
| 011 | 4 ticks, 1/8 of a note | SoundContext = 0 |
| 100 | 8 ticks, 1/4 of a note | SoundContext = 0 |
| 110 | 12 ticks, dotted 1/4 of a note | SoundContext = 0 |
| 110 | 16 ticks, 1/2 of a note | SoundContext = 0 |
| 111 | 32 ticks, whole note | SoundContext = 0 |

The invention claimed is:

1. A hearing aid, comprising:

a sound receiver responsive to sound waves to generate a microphone signal based on the sound waves;

a transmitting unit coupled to receive the microphone signal from the sound receiver and generate a power signal based on the microphone signal;

a sound generator coupled to receive at least the power signal from the transmitting unit and generate a sound based on the power signal, the sound generated by the sound generator effective to be perceived by an auditory organ of a user of the hearing device; and an audio signal unit comprising:

a memory coupled to store at least one generation parameter;

a tone signal generator coupled to the memory to generate a tone signal in response to a trigger signal and as a function of said at least one generation parameter; and a central control unit responsive to a signal indicative of a predefined sound event related to the hearing aid to generate the trigger signal, wherein the audio signal unit is coupled to the sound generator to transmit the tone signal to the sound generator, wherein the tone signal is configured to produce a further sound indicative of an occurrence of the defined event and effective to be perceived by the auditory organ of the user of the hearing device.

2. The hearing aid as claimed in claim 1, wherein the audio signal unit receives a generation parameter dataset and changes said at least one generation parameter stored in the memory to an identical value of a corresponding generation parameter in the generation parameter dataset.

3. The hearing aid as claimed in claim 2, wherein the generation parameter in the generation parameter dataset is represented by a codeword assigned to the tone signal.

4. The hearing aid as claimed in claim 3, wherein the codeword is assigned to the tone signal generator.

5. The hearing aid as claimed in claim 3, wherein the codeword represents an item of information.

6. The hearing aid as claimed in claim 3, wherein the audio signal unit reads the codeword bit-by-bit.

7. The hearing aid as claimed in claim 3, wherein the codeword is a redundancy-reducing code.

8. The hearing aid as claimed in claim 7, wherein the redundancy-reducing code is an arithmetic code or a Huffman code.

9. The hearing aid as claimed in claim 2, wherein the audio signal unit comprises a buffer for the generation parameter dataset.

10. A method for generating a tone signal by a hearing aid, comprising:

generating a microphone signal based on sound waves received by a sound receiver;

generating in a transmitting unit a power signal based on the microphone signal;

generating in a sound generator a sound based on the power signal, the sound generated by the sound generator effective to be perceived by an auditory organ of a user of the hearing device; and arranging in the audio signal unit at least a memory, a tone signal generator and a central control unit storing at least one generation parameter in the memory;

generating a tone signal in the tone signal generator in response to a trigger signal and as a function of said at least one generation parameter;

generating the trigger signal in the central control unit in response to a signal indicative of a predefined sound event related to the hearing aid; and coupling the audio signal unit to the sound generator to transmit the tone signal to the sound generator, wherein the tone signal is configured to produce a further sound indicative of an occurrence of the defined event and effective to be perceived by the auditory organ of the user of the hearing device.

11. The method as claimed in the claim 10, wherein said at least one generation parameter is changed and a further tone signal is generated in response to a further trigger signal and as a function of the changed generation parameter.

12. The method as claimed in the claim 11, wherein the generation parameter is changed to an identical value of a corresponding generation parameter in a generation parameter dataset.

13. The method as claimed in the claim 12, wherein the generation parameter in the generation parameter dataset is represented by a codeword assigned to the tone signal.

14. The method as claimed in the claim 13, wherein the codeword represents an item of information.

15. The method as claimed in the claim 13, wherein the codeword is read bit-by-bit.

16. The method as claimed in the claim 13, wherein the codeword is a redundancy-reducing code.

17. The method as claimed in the claim 16, wherein the redundancy-reducing code is an arithmetic code or a Huffman code.

* * * * *